United States Patent [19]

Estlick

[11] 3,965,798

[45] June 29, 1976

[54] ADAPTIVE ACTUATOR SYSTEM

[75] Inventor: Raymond J. Estlick, Winchester, Mass.

[73] Assignee: Raytheon Company, Lexington, Mass.

[22] Filed: July 2, 1973

[21] Appl. No.: 376,051

[52] U.S. Cl. ..... 91/172; 74/99 R; 91/178; 91/186; 91/390; 91/411 R; 92/68; 188/303; 244/78; 244/85

[51] Int. Cl.[2] ..... F01B 1/00

[58] Field of Search ..... 91/411 R, 363 R, 363 A, 91/390, 183, 194, 171, 172, 178, 186, 189; 92/68, 13.3, 13.1; 74/99 R, 41; 251/229; 244/78, 85, 77 M; 188/300, 303, 304; 192/3 N

[56] References Cited

UNITED STATES PATENTS

| | | | |
|---|---|---|---|
| 2,046,275 | 6/1936 | Mahan | 74/41 |
| 2,548,807 | 4/1951 | Morgan et al. | 74/41 X |
| 2,752,989 | 7/1956 | Jenkins, Jr. | 92/13.3 X |
| 2,954,737 | 10/1960 | Hoover | 92/13.3 X |
| 3,032,015 | 5/1962 | Weinstock | 92/68 |
| 3,054,260 | 9/1962 | Dickinson | 91/390 X |
| 3,065,740 | 11/1962 | Wiedmann et al. | 92/13.1 X |
| 3,095,785 | 7/1963 | Cahill | 92/5 R |
| 3,125,000 | 3/1964 | Reuter | 92/68 |
| 3,253,518 | 5/1966 | Duemler | 92/68 |
| 3,395,886 | 8/1968 | Fawkes | 251/229 |
| 3,401,600 | 9/1968 | Wood | 91/390 X |
| 3,443,521 | 5/1969 | Stender | 92/13.1 X |
| 3,516,331 | 6/1970 | Oelrich | 244/78 X |
| 3,585,902 | 6/1971 | Anderson | 91/363 A |
| 3,618,470 | 11/1971 | Mueller | 91/363 A X |
| 3,696,684 | 10/1972 | Estlick | 251/229 X |
| 3,702,647 | 11/1972 | Richardson | 188/303 X |
| 3,724,330 | 4/1973 | Mason | 91/363 A |
| 3,764,095 | 10/1973 | Schenbeck | 244/77 M |
| 3,766,835 | 10/1973 | Kobelt | 92/68 |
| 3,817,150 | 6/1974 | Cox | 91/186 |
| 3,828,808 | 8/1974 | Ortelli | 251/229 X |

*Primary Examiner*—Martin P. Schwadron
*Assistant Examiner*—Abraham Hershkovitz
*Attorney, Agent, or Firm*—John T. Meaney; Joseph D. Pannone; Harold A. Murphy

[57] ABSTRACT

An adaptive actuator system comprising a rotatable shaft operatively coupled to a torque biasing means for biasing the rotational direction of the shaft, and also operatively coupled to a counter torque developing means for sensing the rotational bias of the shaft and providing a counter torque proportional to the rotational bias.

11 Claims, 14 Drawing Figures

ADAPTIVE ACTUATOR SYSTEM

BACKGROUND OF THE INVENTION

This invention relates generally to actuator systems and is concerned more particularly with an efficient fluid actuator system which is responsive to variations in torque output requirements.

Various instances occur in the operation of mechanical equipment where reciprocally movable actuators produce limited angular motion of a rotatable output shaft. Such an arrangement may be used for the operation of aircraft flaps, landing gear, missile fins, rotatable elevational assemblies, earth moving equipment, freight handling equipment and the like.

In one type of actuator system, for example, oil is forced into a cylinder to move a piston and attached rod linearly. The piston rod generally is pivotally connected to an angularly movable moment arm which is attached to a rotatable shaft. Thus, the piston rod acting on the moment arm produces a torque which rotates the output shaft. However, in the described system, the torque developed is a function of the angle of rotation, regardless of the load on the output shaft. Therefore, the energy expended to achieve a particular angle of rotation is proportional to the quantity of fluid required in the hydraulic drive cylinder rather than to the torque required for the load.

Consequently, the described actuator system usually is designed to provide a fluid flow capability which will produce the required torque under maximum load condition. As a result, it will expend the same quantity of energy to achieve a desired angular rotation of the output shaft under minimum load conditions as under maximum load conditions. Thus, if the described actuator system is used to rotate a missile fin, for example, the energy expended to achieve maximum fin angle will be the same when the missile is at extremely high altitudes as when it is at relatively low altitudes where the aerodynamic pressure against the fin is much greater. Also, if the described actuator system is used to rotate the shovel arm of an earth mover, for example, it will expend the same energy to rotate the shovel arm through a particular angle when the shovel is empty as when the shovel is full. Therefore, for efficient operation, the torque developed for rotating the output shaft should be proportional to the load on the shaft.

Thus, there is a definite need for an efficient actuator system of the described type which is responsive to variations in output torque requirements of the system.

SUMMARY OF THE INVENTION

Accordingly, this invention provides an adaptive actuator system having a rotatable shaft operatively coupled to a torque biasing means for biasing the rotation of the shaft in a particular angular direction, and to a counter torque developing means for sensing the rotational bias of the shaft and providing a counter torque proportional to the bias. The torque biasing means may include a load torque produced by a load acting on a supporting arm attached to the shaft. The torque biasing means also may include a codirectional torque produced by force actuator means acting through a moment arm on the shaft.

The counter torque developing means includes energy conserving actuator means and torque varying means which is responsive to load variations. The counter torque developing means includes an angularly movable moment arm which is fixedly attached to a rotatable output shaft and operatively connected to the energy conserving actuator means and the torque varying means. The energy conserving actuator means comprises a pressurized fluid sub-system having a closed loop including force actuator means operatively engaging the moment arm for exerting a force on the arm. The torque varying means includes a pressurized fluid sub-system having torque control actuator means carried on the moment arm and operatively coupled to the force actuator means for varying the effective radius of the moment arm. The counter torque developing means also includes control means for activating the torque varying means to alter the radius of the moment arm in accordance with the torque required for rotating the output shaft through a desired angle.

A preferred embodiment of this invention comprises a rotatable shaft attached to a central portion of a hollow rocker arm having respective slots longitudinally disposed in opposing end portions of the arm. Slidably disposed within the slot in each end portion is a respective pin which engages a rod extending longitudinally through the arm. The rod is attached to the piston of a torque control actuator which is mounted on one end of the arm and is operatively connected through a servo valve to a pressurized source of hydraulic fluid. The slidable pins also are mechanically coupled to one end of respective piston rods extending from a parallel pair of force actuators. The force actuators have respective closed ends pivotally attached to a fixed support member and are operatively connected through a control valve to a pressurized source of hydraulic fluid. The servo valve and the control valve are operated automatically by a control unit which receives a command signal indicative of a desired angle of rotation of the shaft and determines the required torque necessary for rotating the shaft through the desired angle.

An alternative embodiment is similar to the described preferred embodiment except the torque control actuator is centrally mounted in the hollow rocker arm.

A second alternative embodiment is similar to the described preferred embodiment except the torque control actuator is mounted on the longitudinal side of the arm adjacent the force actuators, and the torque control actuator is mechanically coupled to only one of the force actuator piston rods.

A third alternative embodiment is similar to the described preferred embodiment except only one force actuator is utilized, and one slot extends longitudinally through the central portion of the arm.

BRIEF DESCRIPTION OF THE DRAWINGS

For a better understanding of this invention, the following more detailed description makes reference to the accompanying drawings wherein.

DESCRIPTION OF THE PREFERRED EMBODIMENT

Figure 1:
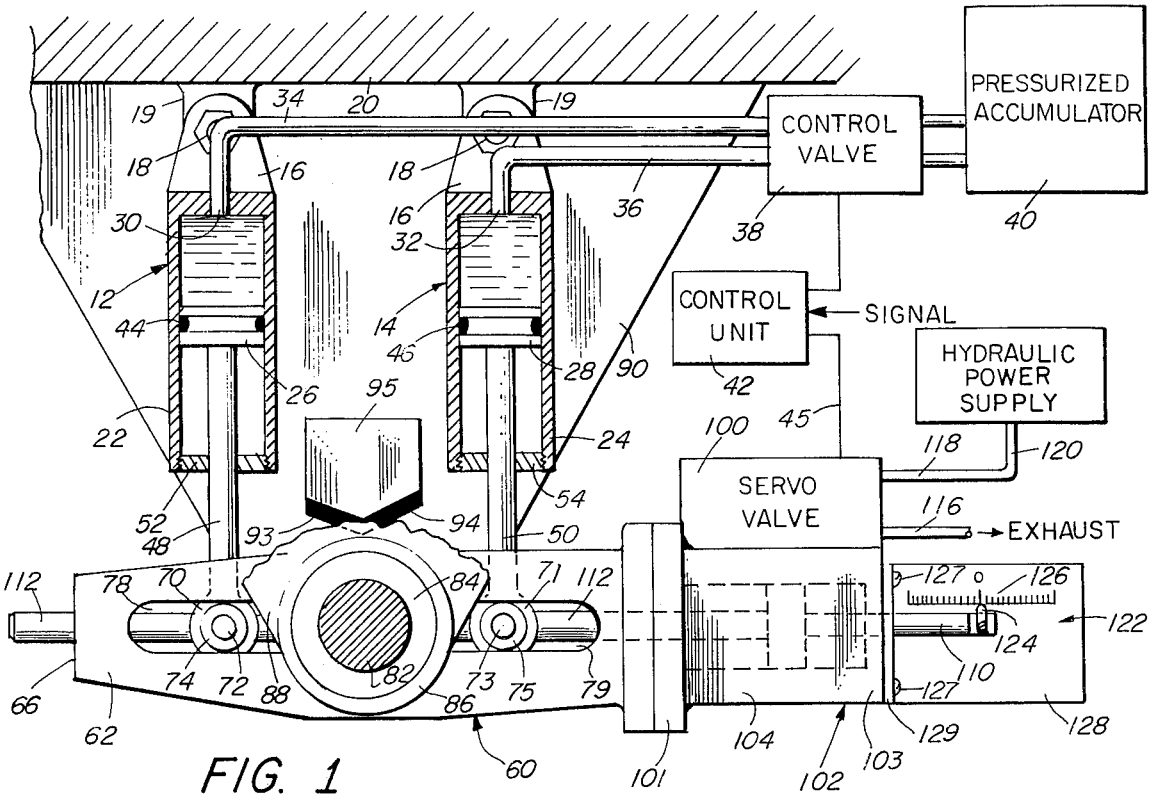
FIG. 1 is a plan view, partly in section, of an actuator system which embodies this invention.
Figure 2:
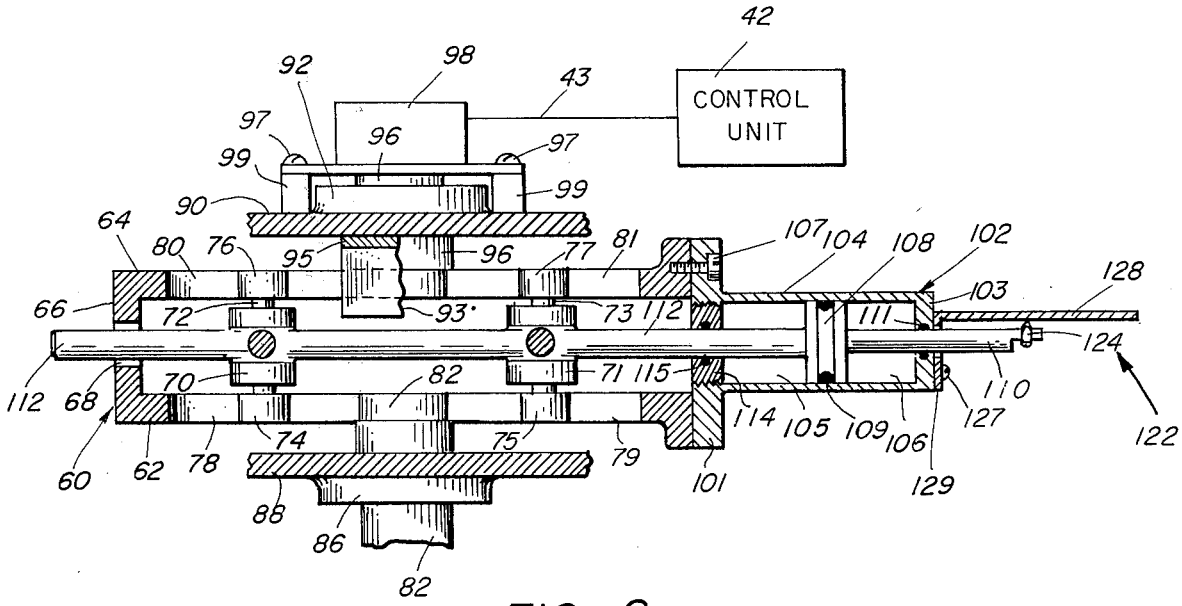
FIG. 2 is a fragmentary elevational view, partly in section, taken substantially along line 2—2 in FIG. 1 and looking in the direction of the arrows.

Referring more particularly to the drawing wherein like characters of reference designate like parts throughout the several views, there is shown in FIGS. 1 and 2 an adaptive actuator system 10 including a pair of cooperating force actuators 12 and 14, respectively, each terminating at one end in a respective rounded end flange 16. The flange 16 are pivotally attached by suitable means, such as bolts 18, for example, to respective lugs 19 which project outwardly from a rigid support structure 20, such as the air frame of a missile for example.

The force actuators 12 and 14 may comprise respective hollow cylinders 22 and 24 having slidably disposed therein reciprocally movable pistons 26 and 28, respectively. Adjacent the end flanges 16, the cylinders 22 and 24 have respective closed ends provided with ports 30 and 32, respectively. The ports 30 and 32 permit the flow of hydraulic fluid into and out of the associated cylinders and are operatively connected to respective flexible conduits 34 and 36, such as plastic hoses, for example. The conduits 34 and 36 are connected through a conventional control valve 38 to a reservoir (not shown) of hydraulic fluid stored in a pressurized accumulator 40. The accumulator 40 may be of conventional design and, preferably, maintains a constant pressure on the fluid in the reservoir. Thus, the accumulator 40 constitutes a pressurized source of hydraulic fluid communicating with the cylinders 22 and 24 by means of the control valve 38 and flexible conduits 34 and 36 respectively. The control valve 38 may be electrically connected through a conductor 41 to a control unit 42 which produces electrical signals for automatically opening and closing the valve 38.

When the control valve 38 is in the open condition, the pressure exerted by accumulator 40 is transmitted through the hydraulic fluid to the adjacent surfaces of pistons 26 and 28, respectively. The pistons 26 and 28 are provided with circumferential O-rings 44 and 46, respectively, which slidingly engage the inner surfaces of the associated cylinders 22 and 24, respectively. Operatively coupled to the pistons 26 and 28 are respective piston rods 48 and 50 which pass axially through apertured end caps 52 and 54, respectively. The end caps 52 and 54, are suitably disposed, as by journalling, for example, in the other ends of the cylinders 22 and 24 respectively. External end portions of the piston rods 48 and 50 extend through an open longitudinal side of a hollow rocker arm 60 and are suitably attached, as by welding, for example, to respective bearing sleeves 70 and 71 disposed within the rocker arm.

As shown more clearly in FIG. 2 the bearing sleeves 70 and 71 rotatably support respective axial pins 72 and 73, each carrying adjacent one end thereof a roller, 74 and 75, respectively, and adjacent the other end a roller, 76 and 77, respectively. The rollers 74 and 76 on pin 72 are slidably engaged in mutually aligned slots 78 and 80, respectively, which are longitudinally disposed in opposing walls, 62 and 64, respectively, of the rocker arm 60, adjacent one end thereof. Similarly, the rollers 75 and 77 on pin 73 are slidably engaged in mutually aligned slots 79 and 81, respectively, which are longitudinally disposed in the opposing walls 62 and 64, respectively, adjacent the other end of rocker arm 60.

The wall 62 of rocker arm 60 is fixedly attached, as by welding, for example, to a centrally disposed end portion of an axially extending shaft 82, which is shown in FIG. 1 as projecting out of the plane of the drawing. The shaft 82 is rotatably supported in a bearing 84 which is retainably mounted in a boss 86 carried on a transversely disposed support arm 88. The arm 88 may conveniently comprise a triangularly shaped plate having a base portion affixed to the support structure 20 and extending outwardly therefrom to an apex portion which supports the boss 86 and bearing 84 in coaxial alignment with the shaft 82. A spaced parallel support arm 90 may conveniently comprise a plate similar in size and shape to the plate of support arm 88 and carry on the adjacent surface thereof an angulated pair of rotational limit stops 93 and 94, respectively, for butting engagement with the rocker arm 60. The stops 93 and 94 may conveniently comprise respective rubberized surfaces of an angled upright wall extending from a base plate 95 which is fixedly attached, as by welding, for example, to the plate of support arm 90.

The apex portion of support arm 90 is provided with a boss 92 having retainably mounted therein a bearing (not shown) which rotatably supports a shaft 96 in axial alignment with the output shaft 82. The shaft 96 has one end portion fixedly attached, as by welding, for example to a central portion of the wall 64 of rocker arm 60 and extends through the support arm 90. The opposing end portion is disposed within a coaxially aligned potentiometer 98 which is suitably mounted, as by screws 97 and spacers 99, for example, and has an internal wiper arm (not shown) operatively coupled to the enclosed end of shaft 96. Thus, angular movements of the attached rocker arm 60 are transmitted through the shaft 96 to rotate the wiper arm of potentiometer 98 correspondingly. The output of potentiometer 98 is electrically connected through a conductor 43 to the control unit 42 whereby the voltage signals produced by rotational movements of the wiper arm are fed back to the control unit 42.

The control unit 42 also is electrically connected through a conductor 45 to a conventional four-way servo valve 100 which is operatively coupled to a torque control actuator 102 carried on one end of the rocker arm 60. The actuator 102 may comprise a hollow cylinder 104 having a flanged open end 101 attached, as by screws 107, for example, to the rocker arm 60 and having an opposing closed end 103. The closed end 103 may be apertured and provided with a conventional O-ring 111 which is slidingly engaged by a piston rod 110 extending axially through the closed end 103 of cylinder 104. An external end portion of piston rod 110 may carry a suitably attached pointer 124 of an indicating means 122 which includes a graduated scale 126 disposed on an adjacent fixed plate 128.

The plate 128 may conveniently be provided with an angled portion 129 which is fastened by conventional means, such as screws 127, for example, to the closed end 103 of cylinder 104.

The piston rod 110 extends axially within the cylinder 104 and has an internal end portion operatively coupled, as by welding, for example, to an adjacent surface of a reciprocally movable piston 108, which is slidably disposed therein. An opposing surface of piston 108 is similarly coupled to an end portion of a second axially extending rod 112 which passes through an apertured end cap 114 suitably disposed, as by journalling, for example, in the flanged end 101 of the cylinder 104. The end cap 114 is provided with a conventional O-ring 115 which is slidingly engaged by the rod 112 extending through the apertured end cap 114. Externally of cylinder 104, the rod 112 extends longitudinally through the rocker arm 60 and is fixedly attached, as by dowelling, for example, to pins 72 and 73, respectively. Thus, a fixed length of the rod 112 separates the respective sleeves 70 and 71, one from the other. A distal end portion of the rod 112 passes freely through an aperture 68 in an end wall 66 of the rocker arm 60.

The reciprocally movable piston 108 of torque control actuator 102 is provided with a circumferential O-ring 109 which slidingly engages the inner surface of cylinder 104. Thus, the piston 108 divides the cylinder 104 into two chambers, 105 and 106, respectively, the volumes of which vary inversely with axial movement of piston 108 and which are operatively connected to the servo valve 100. The valve 100 is connected through a flexible conduit 118 to a hydraulic power supply 120 which constitutes a second pressurized source of hydraulic fluid and may be similar in design to the accumulator 40. However, the servo valve 100 of this fluid-sub-system is connected through a flexible conduit 116 to an exhaust means (not shown) for venting fluid from the system.

When the servo valve 100 is not activated by an electrical signal from the control unit 42, it is resiliently maintained in a closed condition, such that the respective chambers 105 and 106 are not connected to the hydraulic power supply 120 or to the exhaust conduit 116. However, upon receipt of an electrical signal from the control unit 42, the servo valve 100 is electrically operated to connect one of the respective chambers 105 and 106 to the hydraulic power supply 120 while connecting the other chamber to the exhaust conduit 116. As a result, the piston 108 of the torque control actuator 102 is moved axially, either toward the closed end 103 or toward the flanged end 101 of the cylinder 104. Consequently, the piston rods 110 and 112 move the pointer 124 of indicating means 122 and the bearing sleeves 70 and 71, respectively, in the direction corresponding to the movement of piston 108. Simultaneously, the control valve 38 is electrically operated to an open condition by the control unit 42; and the force actuators 12 and 14 pivot about respective bolts 18. Thus, the accumulator 40 is permitted to maintain pressure on the pistons 26 and 28 while the attached rods 48 and 50, respectively, follow the movement of respective bearing sleeves 70 and 71 caused by the torque control actuator 102.

The adaptive actuator system 10 is shown in FIG. 1 as having no load on the output shaft 82, the servo valve 100 in a closed condition, and equal volumes of hydraulic fluid disposed in the respective chambers 105 and 106 of cylinder 104. As a result, the piston 108 of torque control actuator 102 is disposed in the neutral mid-position, as indicated by the zero reading of the operatively connected pointer 124 of indicating means 122. Consequently, equal lengths of the attached rod 112 are positioned between the axial centerline of output shaft 82 and the respective bearing sleeves 70 and 71. These equal lengths of rod 112 represent respective moment arms of equal radial length, each having a respective force applied thereto through the bearing sleeve 70 and 71, respectively, when control valve 38 is open. The moment arms are formed by the forces on the bearing sleeves 70 and 71 acting through the axial pins 72 and 73 and aligned rollers 74–77 to apply pressure against peripheral portions of the associated slot 78–81, respectively.

The forces on the bearing sleeves 70 and 71 are produced by the accumulator 40 maintaining a constant pressure on the hydraulic fluid which transmits it through open control valve 38 to the respective pistons 26 and 28. Accordingly, the connecting piston rods 48 and 50, respectively, exert equal forces on the respective bearing sleeves 70 and 71 which apply these forces, as described, to the associated equal moment arms. The resulting equal torque forces, thus developed, tend to rotate the rocker arm 60 in opposing angular directions and therefore, cancel one another completely. Consequently, the rocker arm 60 does not rotate the attached output shaft 82; and the adaptive actuator system 10 is disposed in a static condition. Nevertheless, it should be noted that the respective force actuators 12 and 14, the accumulator 40, and the respective fluid conduits 34 and 36 form a closed loop sub-system wherein potential energy is stored for performing work, such as the rotation of output shaft 82, for example.

However, the described static condition of the adaptive actuator system 10 generally is not achieved in practice, because there usually is a load on the output shaft 82. The load may be dynamic in nature, such as the aerodynamic pressure on a missile fin or the water pressure on a ship's rudder, for examples. The load also may be inertial, such as the weight of a snow plow blade or a farm tractor hoe on its supporting lever arms, for examples. The load also may vary radically, such as the loaded and unloaded conditions of a shovel on an earth mover or of the arms on a fork-lift truck, for examples. However, even in the unloaded condition, the load handling device has a weight of its own which represents a load on the output shaft 82. Thus, in any of these instances, the load produces a rotational biasing torque which tends to rotate the output shaft 82 in a complying angular direction. As a result, the bias torque cooperates with one of the opposing torques produced by the force actuators 12 and 14, respectively.

Figure 3A:
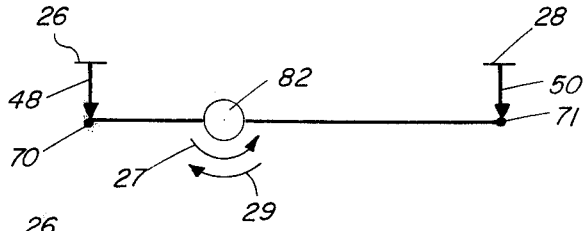
FIGS. 3*a*–3*e* is a related series of schematic views illustrating operation of the actuator system shown in FIG. 1.

For purposes of illustrating this invention, the load on shaft 82 is considered as being constant and producing a rotational biasing torque which cooperates with the torque produced by the force actuator 12. Accordingly, as shown in FIG. 3*a*, the combined torques produced by the load on shaft 82 and the force actuator 12 constitute respective components of a rotational biasing means which tends to rotate the output shaft 82 in the counterclockwise direction, as indicated by the arcuate arrow 27. In response to a "Stable Zero Angular Position" signal from a remote intelligence source (not shown), such as a navigational guidance computer, for example, the control unit 42 sends appropriate electrical signals to control valve 38 and servo valve 100, respectively. Therefore, control valve 38 is opened; and the torque control actuator 102 is activated by servo valve 100 to increase the length of the moment arm associated with the force actuator 14, while decreasing the length of the moment arm associated with force actuator 12 correspondingly. Consequently, the counter torque developed by the force actuator 14, as indicated by the arcuate arrow 29, is sufficient to counterbalance the resulting rotational bias means, which is represented by the equal length but oppositely directed arrow 27. The required changes in length of the respective moment arms in order to maintain rocker arm 60 and output shaft 82 stable at zero angular displacement, as described, is indicated by the pointer 124 on the graduated scale 126 of the indicating means 122. Thus, it may be seen that the adaptive actuator system 10 of this invention provides means for sensing the load on output shaft 82 and means for indicating the magnitude of the rotational bias.

When the control unit 42 receives an angle-command signal from the remote intelligence source, the control unit sends an appropriate signal to the servo valve 100. As a result, the servo valve 100 is electrically operated to connect, for example, the chamber 105 to the hydraulic power supply 120 and to connect the chambers 106 to the exhaust conduit 116. Consequently, hydraulic fluid, under pressure, flows into chambers 105 and moves the piston 108 toward the closed end of cylinder 104, thereby venting fluid from the chamber 106 through the exhaust conduit 116. Accordingly, the operatively connected pointer 124 of indicating means 122 and bearing sleeves 70 and 71, respectively, are moved in the same direction and at the same rate as the moving piston 108. As a result the moment arms, represented by the respective lengths of rod 112 disposed between the axial centerline of output shaft 82 and the bearing sleeves 70 and 71 become increasingly unequal. Also, the force actuators 12 and 14 are pivoted correspondingly about the bolts 18 at their respective flanged ends 16, while the control valve 38 is retained in the open condition by the control unit 42.

Figure 4:
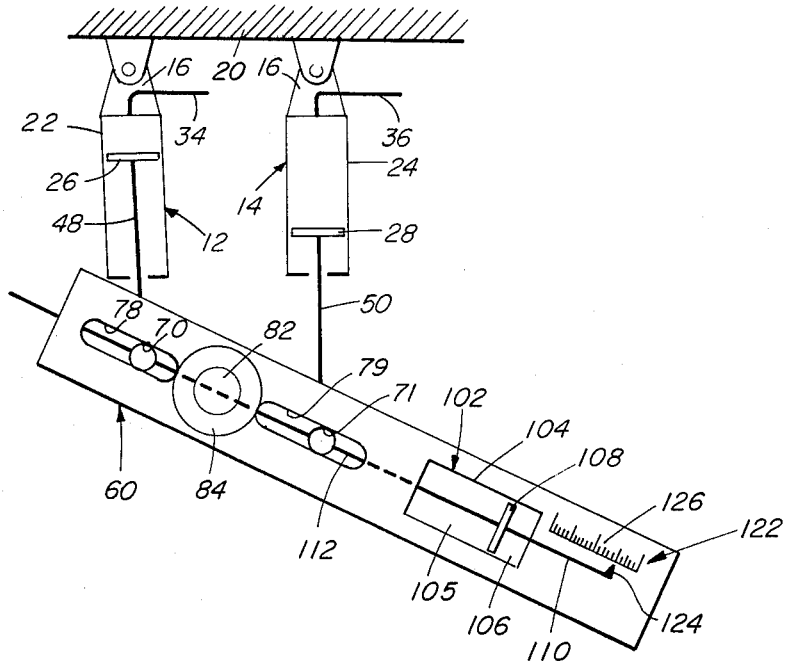
FIG. 4 is a schematic plan view, partly in section, of the system shown in FIG. 1 with the rocker arm rotated clockwise.
Figure 3B:
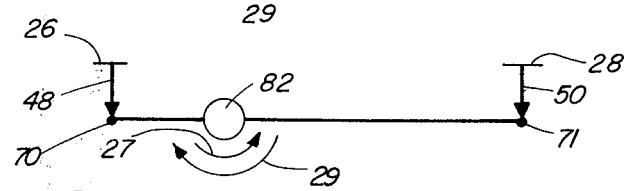

Thus, the accumulator 40 continues to maintain a constant pressure on the respective pistons 26 and 28 thereby causing piston rods 48 and 50, respectively, to exert equal forces on the associated bearing sleeves 70 and 71, respectively. However, as shown in FIG. 3*b*, the force on bearing sleeve 70 is applied to an associated moment arm which is decreasing in length; while the force on bearing sleeve 71 is applied to an associated moment arm which is increasing in length correspondingly. Consequently, the rotational biasing means comprising the combined torques developed by the force actuator 12 and the load on shaft 82 no longer completely cancels the torque developed by the force actuator 14, as indicated by the unequal length of the arcuate arrows, 27 and 29, respectively. The tendency of the unbalanced torque developed by force actuator 14 to rotate the output shaft 82 is resisted by the load on shaft 82, such as the aerodynamic pressure on a missile fin, for example, and by the force actuator 12. Nevertheless, the unbalance torque need only slightly exceed the combined torques developed by the load on shaft 82 and the force actuator 12 in order to rotate the rocker arm 60 and output shaft 82 through a maximum angular displacement, if desired, as shown in FIG. 4. An indication of the magnitude of the counter torque required to slightly exceed the rotational biasing means operating on shaft 82 is provided by the indicating means 122.

When the rocker arm 60 begins to rotate the output shaft 82, it also rotates the shaft 96 and the operatively connected wiper arm of potentiometer 98 thereby sending a change in the voltage output signal to the control unit 42. Thus, the potentiometer 98 constitutes a rotation detecting means which informs the control unit 42 when the output shaft 82 has begun to rotate in the proper direction for achieving the commanded angular displacement of shaft 82; and, therefore, the unbalanced torque exceeds the load on shaft 82. Consequently, the control unit 42 ceases sending a signal to servo valve 100 thereby permitting it to return resiliently to a closed position. Accordingly, the chambers 105 and 106 are disconnected from the hydraulic power supply 120 and the exhaust conduit 116, respectively, thus fixing the respective positions of the piston 108 and the operatively connected bearing sleeves 70 and 71. As a result, the unbalanced counter torque rotating output shaft 82 is stabilized at a value which slightly exceeds the combined torques produced by force actuator 12 and the load on the shaft. Therefore, the magnitude and direction of the unbalanced counter torque rotating output shaft 82 is determined by the open-loop sub-system comprising the hydraulic power supply 120, the torque control actuator 102, and the exhaust conduit 116. Also, it may be seen that, in this instance, the unbalanced counter torque developed is proportional to the quantity of hydraulic fluid displaced from the chamber 106 by the necessary movement of piston 108 to develop the unbalanced torque.

The resulting rotation of rocker arm 60 exerts a pressure on the bearing sleeve 70 which causes the operatively coupled piston 26 to move toward the closed end of cylinder 22. Consequently, hydraulic fluid is forced out of the cylinder 22 and through the conduit 34 to the accumulator 40. Simultaneously, the constant pressure exerted by the accumulator 40 on the reservoir therein causes fluid to flow through the conduit 36 and into the cylinder 24, thus maintaining a constant pressure on piston 28. Therefore, piston 28 continues to apply a constant force, through the bearing sleeve 71, to the associated moment arm, thereby sustaining the unbalanced counter torque rotating the output shaft 82. Accordingly, even though the unbalanced counter torque is fixed at a value only slightly exceeding the rotational biasing means operating on shaft 82, the force actuator 14 continues to rotate the rocker arm 60 and output shaft 82 through the desired angular displacement.

Thus, it may be seen that the work performed in rotating the output shaft 82 is accomplished by expending potential energy stored in the closed loop sub-system comprising the accumulator 40 and the hydraulically connected force actuators 12 and 14, respectively.

While output shaft 82 and rocker arm 60 are being rotated through the desired angular displacement, the potentiometer 98 sends corresponding continuous changes in output voltage to the control unit 42. Consequently, when the desired angular displacement of rocker arm 60 and output shaft 82 has been achieved, the output voltage signal from potentiometer 98 nulls the command signal received from the remote intelligence source by the control unit 42. As a result, the control unit 42 sends an appropriate signal to the electrically operated, control valve 38 to close the valve thereby isolating force actuators 12 and 14 from the pressure exerted by the accumulator 40. In this manner, the respective positions of pistons 26 and 28 are fixed thereby holding the rocker arm 60 and output shaft 82 at the desired angular position.

Figure 3C:
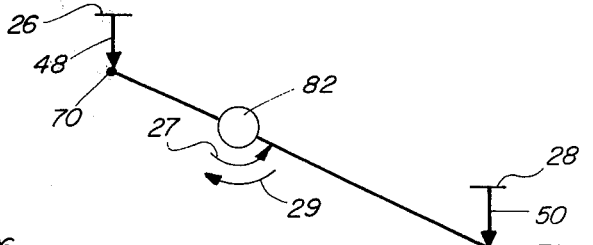

When a return-angle command signal is received from the remote intelligence source, the control unit 42 initiates a suitably timed signal for opening control valve 38, and sends an appropriate signal to the servo valve 100. As a result, servo valve 100 is electrically operated to connect the chamber 106 to the hydraulic power supply 120 and the chamber 105 to the exhaust conduit 116. Accordingly, hydraulic fluid flows into chamber 106 and starts the piston 108 moving toward the flanged end of cylinder 104 thereby venting fluid from the chamber 105. Consequently, the pointer 124 of indicating means 122 and the respective bearing sleeves 70 and 71 move in the same direction as the moving piston 108. Therefore, the force actuators 12 and 14 pivot about their respective flanged ends, and the associated moment arms change in radial length correspondingly. Thus, as shown in FIG. 3*c*, the unbalanced counter torque associated with force actuator 14 decreases steadily in magnitude until it is slightly less than the rotational biasing means, as indicated by the unequal lengths of the arcuate arrows 29 and 27, respectively. When this occurs, in conjunction with the opening of control valve 38, the output shaft 82 begins rotating in the reverse angular direction; and the pointer 124 of indicating means 122 provides an indication of the reduced magnitude of the counter torque. Thus, the adaptive actuator system 10 senses the load on shaft 82 to reduce the counter torque to a value which is slightly less than the rotational bias, and also provides an indication of the magnitude of the reduced counter torque.

As the shaft 82 starts to rotate in the reverse angular direction, counterclockwise in this instance, the aligned shaft 96 begins to rotate the wiper arm of potentiometer 98 accordingly. The resulting change in the output voltage signal from potentiometer 98 informs the control unit 42 that the shaft 82 has begun to rotate in the reverse angular direction and, therefore, the unbalanced torque is now slightly less than the shaft load. Consequently, the control unit 42 ceases sending a signal to the servo valve 100, thus permitting the valve to return resiliently to its closed position. As a result, the chambers 105 and 106 are disconnected from the exhaust conduit 116 and the hydraulic power supply 120 thereby fixing the respective positions of piston 108 and bearing sleeves 70 and 71. Accordingly, the reduced counter torque associated with the force actuator 14 is stabilized at a desired value less than the rotational biasing means comprising the codirectional torques produced by the load on shaft 82 and the force actuator 12. Thus, it may be seen that the desired value of reduced counter torque is determined by the servo-loop subsystem comprising the hydraulic power supply 120, the torque control actuator 102, and the exhaust conduit 116. It also should be noted that the required reduction in counter torque is achieved by a correlative movement of piston 108, which is proportional to the quantity of hydraulic fluid vented from the chamber 105.

Since the control valve 38 is now open, the pressure exerted on bearing sleeve 71 by the reverse rotational motion of rocker arm 60 causes the piston 28 to move toward the closed end of cylinder 24. Therefore, hydraulic fluid is forced out of the cylinder 24 and back through the conduit 36 to the accumulator 40. Simultaneously, the pressure exerted by the accumulator 40 on the reservoir therein causes fluid to flow through conduit 34 and into cylinder 32, thus maintaining a constant pressure on piston 26. The resulting force applied through the operatively connected bearing sleeve 70 aids in sustaining the counterclockwise rotation of rocker arm 60 and shaft 82. In this manner, potential energy is restored to the closed loop sub-system comprising the accumulator 40 and the hydraulically connected force actuators 12 and 14, respectively, as the output shaft 82 rotates back toward its initial angular position.

Figure 3D:
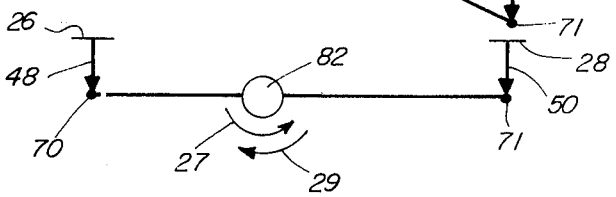
Figure 3E:
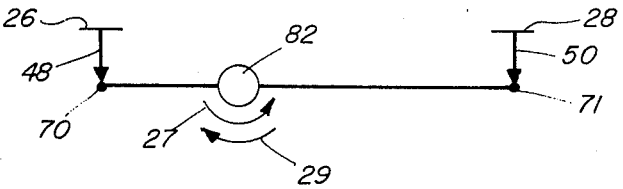

While the rocker arm 60 and output shaft 82 are rotating in the counterclockwise direction, the potentiometer 98 continues to send to the control unit 42 corresponding changes in output voltage. Consequently, the output voltage of potentiometer 98 begins to approach in value the magnitude of the return-angle signal received by the control unit 42 from the remote intelligence source. As a result, when the output shaft 82 and rocker arm 60 achieve the desired return-angle position, such as zero angular position, for example, the output voltage signal from potentiometer 98 nulls the return-angle signal received from the remote intelligence source. Accordingly, the control unit 42 sends to the control valve 38 a suitable electrical signal for closing the valve, thereby hydraulically locking the rocker arm 60 and the output shaft 82 in the desired return-angle position, as shown in FIG. 3*d*. When desired, the counter torque associated with force actuator 14 may be increased to balance the rotational bias of shaft 82, as shown in FIG. 3*e*, by a Stable Zero Angular Position signal sent to the control unit 42 from the remote intelligence source, as previously described in connection with FIG. 3*a*.

Thus, it may be seen that the output shaft 82 is rotated through a commanded angular displacement from its initial position by expending potential energy from the closed loop sub-system comprising the accumulator 40 and hydraulically connected force actuators 12 and 14, respectively. However, the expended potential energy is restored to this closed loop sub-system when the load rotates the shaft 82 back to its initial angular position. Consequently, the closed loop sub-system constitutes an energy conserving system which does not dissipate energy over a full cycle of operation.

The energy expended by the adaptive actuator system 10 is represented by the quantity of hydraulic fluid vented from the servo loop sub-system comprising the hydraulic power supply 120, the torque control actuator 102, and the exhaust conduit 116. Thus, for rotating the shaft 82 through a commanded angular displacement from its initial position, the servo loop sub-system vents the minimum quantity of hydraulic fluid necessary for moving piston 108 a sufficient distance to develope a counter torque which is slightly greater than the rotational bias of shaft 82. Also, for rotating the shaft 82 back to its initial angular position, the servo loop sub-system vents the minimum quantity of hydraulic fluid necessary for returning the piston 108 a sufficient distance to develop a counter torque which is slightly less than the rotational bias of shaft 82. Therefore, the servo loop sub-system constitutes a torque varying system which determines the counter torque required for rotating the output shaft 82 in a desired angular direction under variable load conditions. Accordingly, the adaptive actuator system 10 operates very efficiently over a full operational cycle by expending minimum energy to develop counter torques which are proportional to the rotational bias of shaft 82.

Figure 5:
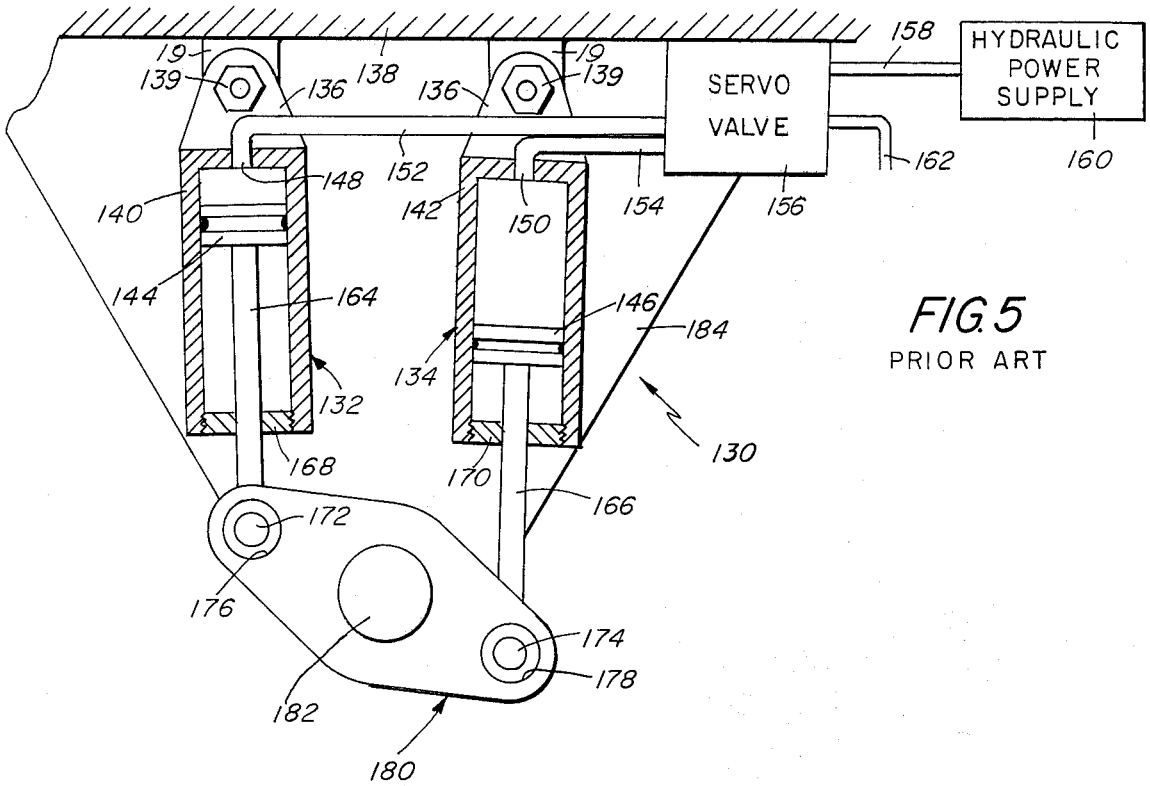
FIG. 5 PRIOR ART
FIG. 5 is a schematic plan view, partly in section, of a prior art system similar in type to the embodiment shown in FIG. 1.

FIG. 5 shows a conventional actuator system 130 of a similar type which includes a pair of cooperating force actuators 132 and 134, respectively. The force actuators 132 and 134 are provided with respective flanged ends 136 which are pivotally attached to a rigid support structure 138, as bolts 139, for example. Each of the force actuators 132 and 134 comprises a respective hollow cylinder 140 and 142 having slidably disposed therein reciprocally movable pistons 144 and 146, respectively. Adjacent the flanged ends 136, the cylinders 140 and 142 terminate in respective closed ends which have disposed therein ports 148 and 150, respectively. The ports 148 and 150 are suitably connected to respective fluid conduits 152 and 154 which, in turn, are operatively coupled to a servo valve 156. The servo valve 156 is connected through a fluid conduit 158 to a hydraulic power supply 160, and also is connected through a conduit 162 to an exhaust means (not shown).

The servo valve 156 is resiliently maintained in a closed condition whereby the force actuators 132 and 134, respectively, are not connected to the hydraulic power supply 160 or to the exhaust conduit 162. Consequently, the fluid confined between the servo valve 156 and the adjacent surfaces of pistons 144 and 146, respectively, serves to lock the pistons in place. The opposing surfaces of the pistons 144 and 146 are operatively coupled to respective piston rods 164 and 166 which extend axially through apertured end caps 168 and 170, respectively, suitably disposed in the other ends of the cylinders 140 and 142, respectively. External end portions of the piston rods 164 and 166 carry respective radially extending pins 172 and 174 which are pivotally engaged in bearing sleeves 176 and 178, respectively, suitable disposed in opposing end portions of a rocker arm 180. The rocker arm 180 has a central portion fixedly secured to an output shaft 182 which is rotatably supported in a bearing (not shown) mounted in a fixed supporting arm 184. The supporting arm 184 may comprise a triangular shaped plate having a base portion fixedly attached to the supporting structure 138 and extending outwardly therefrom to an apex portion which supports the rotatable shaft 182.

The servo valve 156 may be operated to connect one of the force actuators, such as 134, for example, to the hydraulic power supply 160 and the other force actuator, such as 132, for example, to the exhaust conduit 162. Accordingly, hydraulic fluid, under pressure, flows into the cylinder 142 and causes the piston 146 to slide axially toward the end cap 170. Consequently, the piston rod 166 exerts a pressure, through pin 174, on bearing sleeve 178 which converts the linear motion of piston rod 166 into a corresponding torque which moves rocker arm 180 angularly. As a result, the attached output shaft 182 is rotated in the clockwise direction, as viewed in FIG. 5, and the opposing end portion of rocker arm 180 exerts a pressure, through bearing sleeve 176, on pin 172. Thus, angular movement of rocker arm 180 is converted into corresponding linear movement of piston rod 164 which causes the coupled piston 144 to slide axially toward the closed end of cylinder 140. Therefore, a quantity of hydraulic fluid equal in volume to the quantity ported into cylinder 142 is vented from cylinder 140 through exhaust conduit 162. When the rocker arm 180 and output shaft 182 achieve the desired angular position, the servo valve 156 is closed thereby locking the pistons 144 and 146 in place. In order to return, the rocker arm 180 and output shaft 182 to the initial angular position, a quantity of hydraulic fluid equal in volume to the initiating quantity is ported into cylinder 140 thereby reversing the described operation and causing an equal quantity of hydraulic fluid to be vented from the cylinder 142.

Thus, in the described prior art system 130, the output shaft 182 is rotated through a desired angular displacement which is proportional to an associated quantity of hydraulic fluid moving the driving piston, 146 in this instance, through a corresponding linear distance. The associated quantity of hydraulic fluid acting on the driving piston 146 is approximately equal in volume to the quantity of hydraulic fluid vented from the system by the corresponding movement of the driven piston 144. Accordingly, this quantity of fluid vented from cylinder 140 is representative of the energy expended by the system 130 in rotating the output shaft 182 through the desired angular displacement. Thus, it may be seen that the quantity of energy expended by the described system 130 is constant for any particular angular displacement of the output shaft 182, regardless of the load on the shaft. Consequently, the prior art system 130 expends the same quantity of energy in rotating the output shaft 182 through a particular angular displacement under minimum load conditions, such as the aerodynamic pressure on a missile fin at extremely high altitudes, for example, as it expends in rotating the shaft 182 through the same angular displacement under maximum load conditions. Furthermore, an equal quantity of energy is expended by the described system 130 in returning the output shaft to the initial angular position. Therefore, over a full operational cycle, the prior art system 130 operates much less efficiently than the adaptive actuator system 10 of this invention.

Figure 6A:
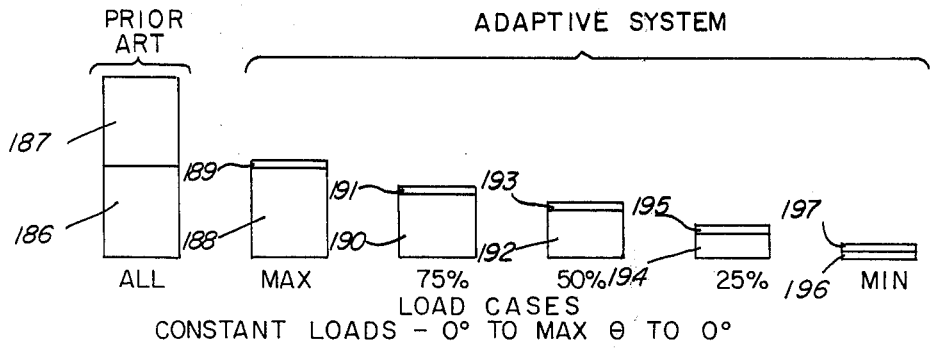
FIGS. 6*a*–6*b* are graphical views of the reduced energy requirements of this invention as compared to the prior art system under constant load and variable load conditions respectively.

FIG. 6*a* shows a bar-type graph indicating the relative quantities of hydraulic fluid required for developing torques to rotate the output shaft while a constant load is on the shaft during the entire operational cycle. For purposes of illustration, the output shaft is considered as being rotated through a miximum angular displacement and returned to a zero angular position for a complete operation cycle.

The block 186 represents the quantity of hydraulic fluid required by the described prior art system 130 for developing a torque to rotate the output shaft 182 through maximum angular displacement. Block 187 represents the equal quantity of hydraulic fluid required by the prior art system to return to output shaft 182 to zero angular position. Thus, the combined blocks 186 and 187 represent the total quantity of energy expended by the system 130 over a full operation cycle. As stated previously, in the operation of the described prior art system 130, the quantities 186 and 187, respectively, are constant for a particular angular displacement of output shaft 182 regardless of the load on the shaft.

Block 188 represents the quantity of hydraulic fluid required by the torque control actuator 102 of adaptive actuator system 10 for developing an unbalanced counter torque which is slightly greater than the rotational bias of shaft 82 in order to rotate shaft 82 through the same maximum angular displacement by the closed loop sub-system. The block 189 represents the quantity of hydraulic fluid required by the torque control actuator 102 for reducing the counter torque to a value slightly less than the rotational bias of shaft 82 in order to have the shaft 82 rotated back to its zero angular position by the rotational biasing means. Thus, the combined blocks 188 and 189, respectively, represent the total quantity of energy expended by the adaptive actuator system 10 over a full operational cycle, with a maximum load on the shaft 82.

Blocks 190, 192, 194 and 196 represent progressively lesser quantities of hydraulic fluid required by the torque control actuator 102 for developing corresponding lower values of unbalanced counter torque, each of which is slightly greater than an associated lower value of rotational bias caused by a lighter load on output shaft 82. Consequently, in each instance, the closed loop sub-system is provided with the proper length moment arm for developing a proportionate counter torque to rotate the output shaft 82 through the same maximum angular displacement as previously specified. The blocks 191, 193, 195 and 197 represent respective quantities of hydraulic fluid required by the torque control actuator 102 for reducing the proportionate counter torque to values slightly less than the associated rotational biasing means. As a result, the rotational bias of shaft 82, in each instance, is capable of returning the shaft to zero angular position. Thus, the block combinations 190–191, 192–193, 194–195 and 196–197, respectively, represent progressively lower quantities of energy expended by the adaptive actuator system 10, over a full operational cycle, as the load on output shaft 82 decreases.

FIG. **6*b*** shows a similar bar-type graph indicating the relative quantites of hydraulic fluid required for developing torques to rotate the output shaft while a varying load is on the shaft during an operational cycle. For purposes of illustration, the operational cycle comprises rotating the output shaft through maximum angular displacement while a particular load is on the shaft and returning the shaft to zero angular position while a reduced load is on the shaft. The variable load may constitute the loaded and unloaded arms of a fork lift truck or the loaded and unloaded scoop shovel of earth moving equipment, for examples. In each instance, a load is received and the output shaft is rotated through a maximum angular displacement. Then the load is removed and the shaft is rotated back to zero angular position under the inertial weight of the load handling device.

Figure 6B:
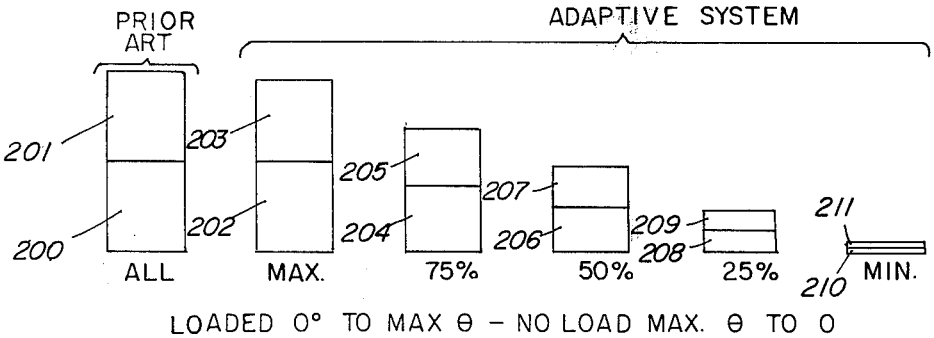

The block 200 represents the quantity of hydraulic fluid required by the described prior art system 130 for developing a torque to rotate the shaft 182 through a maximum angular displacement while a full load is on the shaft. Block 201 represents the equal quantity of hydraulic fluid required by the prior art system 130 to return the output shaft to zero angular position while there is a reduced load on the shaft 182. Thus, the combined blocks 200 and 201 represent the total quantity of energy expended by the system 130 over an entire operational cycle. It should be noted that this quantity of energy is equal to the quantity represented by the combined blocks 186 and 187 in FIG. 6 for the same operational cycle, since the system 130 does not provide means for sensing the load on the shaft 182. Block 202 represents the quantity of hydraulic fluid required by the torque control actuator 102 for developing an unbalanced counter torque which is slightly greater than the rotational bias of shaft 82, under full load conditions. Accordingly, the shaft 82 is rotated through a maximum angular displacement by force actuator 14 of the closed loop sub-system. Block 203 represents the quantity of hydraulic fluid required by the torque control actuator 102 for reducing the counter torque to a value slightly less than the reduced rotational biasing means resulting from the reduced load on shaft 82. Accordingly, the shaft 82 is rotated back to its zero angular position by the reduced rotational bias of shaft 82. Thus, the quantity of hydraulic fluid represented by the block 203 is slightly less than the quantity of hydraulic fluid represented by the clock 201, because the adaptive actuator system 10 makes use of the torque provided by the reduced load to rotate the output shaft in a complying angular direction.

Block 204, 206, 208 and 210 represent progressively lesser quantities of hydraulic fluid required by the torque control actuator 102 for developing corresponding lower values of unbalanced counter torque, similar to the equivalent instances shown in FIG. **6*a*. However, the associated blocks 205, 207, 209, and 211, respectively, represent the increased quantities of hydraulic fluid required as compared to the equivalent instances shown in FIG. 6*a* because of the reduced load on the shaft 82 when the shaft is being returned to its zero angular position. Further comparison of FIGS. 6 and 7 reveals the value of adaptive actuator system 10 having means for sensing the rotational bias of shaft 82 and utilizing the torque provided by the load on shaft 82** to rotate the shaft in a complying angular direction.

Figure 7:
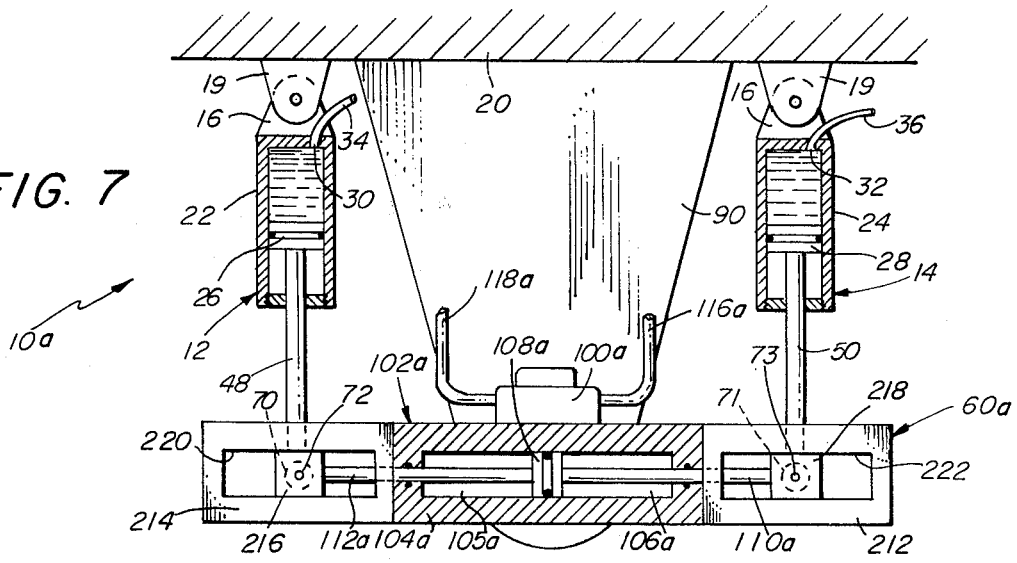
FIG. 7 is plan view, partly in section, of one alternative embodiment of this invention.

FIG. 7 shows an alternative embodiment **10*a* which includes a torque control actuator 102*a* centrally disposed in a rocker arm 60*a*. The torgue control actuator 102*a* comprises a hollow cylinder 104*a* having slidably disposed therein a reciprocally movable piston 108*a* which divides the interior of cylinder 104*a* into two chambers 105*a* and 106*a*, respectively. Opposing surfaces of the piston 108*a* are operatively coupled to respective rods 112*a* and 110*a* which extend axially through opposing end walls of the chambers, 105*a* and 106*a*, respectively. The rods 112*a* and 110*a* extend into opposing hollow end portions, 214 and 212, respectively of the rocker arm 60*a* and are fixedly attached to respective bearing sleeves 70 and 71. The bearing sleeves 70 and 71, as previously described, are fixedly attached to respective piston rods 48 and 50 of the force actuators, 12 and 14, respectively, and pivotally support respective axial pins 72 and 73. The pins 72 and 73 carry on opposing ends thereof respective blocks 216 and 218 which are slidingly engaged in aligned slots, 220 and 222, respectively, disposed in opposing walls of the rocker arm 60*a***.

The chambers **105*a* and 106*a* of the cylinder 104*a* are operatively connected to a servo valve 100*a* which is suitably coupled to the torque control actuator 102*a*. The servo valve 100*a* is connected through a flexible conduit 118*a* to a pressurized source (not shown) of hydraulic fluid, such as hydraulic power supply 102, for example, and also is connected through a flexible conduit 116*a* to an exhaust means (not shown). The exterior of torque control actuator 102*a* may have a block-like configuration with opposing rectangular surfaces (not shown) fixedly attached to rotatable shafts 82 and 96, respectively, similar to the manner shown in FIG. 2, for example. Thus, the alternative embodiment 10*a*** operates substantially as described in the discussion of adaptive actuator system 10 shown in FIGS. 1–4. One of the respective rods 112*a* and 110*a* may be extended axially through the associated hollow end portion of rocker arm 60*a* to provide an indicator means, such as 122 shown in FIGS. 1–3, for example.

Figure 8:
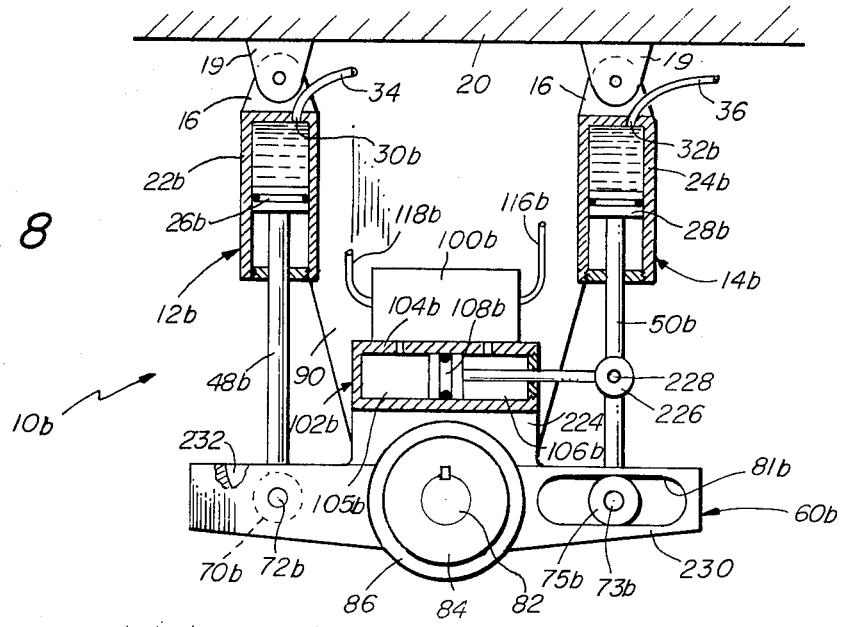
FIG. 8 is a plan view, partly in section, of a second alternative embodiment of this invention.

FIG. 8 shows a second alternative embodiment 10*b* which includes a rocker arm 60*b* having centrally disposed on the side thereof adjacent the force actuators, 12*b* and 14*b*, respectively, a thickened wall portion 224 The wall portion 224 supports a suitably attached torque control actuator 102*b* between the force actuators 12*b* and 14*b*, respectively. The torque control actuator 102*b* comprises a hollow cylinder 104*b* having slidably disposed therein a reciprocally movable piston 108*b* which divides the interior of cylinder 104*b* into two chambers, 105*b* and 106*b*, respectively. The chambers 105*b* and 106*b* are operatively connected to a servo valve 100*b* which is suitably attached to the torque control actuator 102*b*, on the side thereof adjacent the rigid support structure 20. The servo valve 100*b* is connected through a flexible conduit 118*b* to a pressurized source (not shown) of hydraulic fluid, such as hydraulic power supply 120, for example, and also is connected through a flexible conduit 116*b* to an exhaust means (not shown).

The surface of piston 108*b* adjacent the chamber 106*b* is operatively coupled to an end portion of a piston rod 110*b* which extends axially through an opposing end wall of the chamber 106*b*. The external end portion of rod 110*b* carries a bearing sleeve 226 which is pivotally engaged by a pin 228 extending radially from the piston rod 50*b* of force actuator 14*b*. The pin 228 is fixedly attached to an intermediate portion of rod 50*b* which is operatively coupled, at one end, to piston 28*b* slidably disposed in cylinder 24*b* of force actuator 14*b*. The opposing end portion of rod 50*b* extends into an aligned hollow end portion 230 of rocker arm 60*b* and is fixedly attached therein to a bearing sleeve (not shown), as illustrated in FIGS. 1–3, for example. The bearing sleeve pivotally supports an axial pin 73*b* which carries on opposing end portions thereof respective rollers 75*b* (only one of which is shown). The rollers 75*b* are slidably engaged in the mutually aligned slots 79*b*, (only one being shown), which are axially disposed in respective opposing walls of the rocker arm 60*b*.

The piston rod 48*b* of force actuator 126 extends into an aligned cavity 232 in the rocker arm 60*b* and is fixedly attached therein to a bearing sleeve 70*b* which is rotatable about an axial pin 72*b* having opposing end portions affixed to opposing walls of the rocker arm 60*b*. As a result, the length of the moment arm extending between the pin 72*b* and the axial centerline of output shaft 82 is fixed. Consequently, the force actuator 12*b* develops a predetermined torque which biases the output shaft 82 to rotate in a complying angular direction. On the other hand, the torque control actuator 102*b* acts on the piston rod 50*b* to move the pin 73*b* along the respective slots 79*b*, thereby varying the length of the moment arm extending between the pin 73*b* and the axial centerline of shaft 82. In this manner, the torque developed by the force actuator 14*b* may be varied relative to the torque developed by the force actuator 12*b* to cause rotation of the shaft 82 in a desired angular direction. Thus, the torque developed by the force actuator 12*b* is analogous to a bias voltage applied to the grid of an electron tube, for example; and the torque developed by the force actuator 14*b* is analogous to a variable signal voltage applied to the grid of the tube. Accordingly, a very sensitive control of the rotational direction of shaft 82 can be achieved with relatively small changes in torque developed by the force actuator 14*b*.

Figure 9:
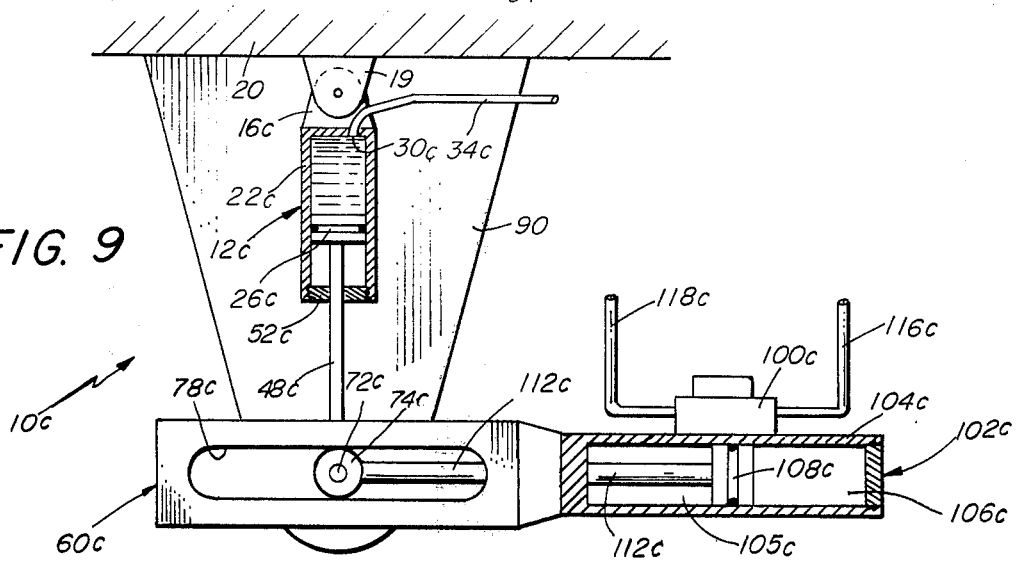
FIG. 9 is a plan view, partly in section, of a third alternative embodiment of this invention.

FIG. 9 shows a third alternative embodiment 10*c* comprising a single force actuator 12*c* having a flanged end 16*c* pivotally attached to the rigid support structure 20. The force actuator 12*c* includes a hollow cylinder 22*c* having slidably disposed therein a reciprocally movable piston 26*c*. Adjacent the flanged end 16*c*, the cylinder 22*c* is provided with a closed end having therein a port 30*c* which is suitably connected to a flexible conduit 34*c*. The conduit 34*c* may be connected through a control valve, such as 38, for example, to a pressurized accumulator, such as 40, for example. Accordingly, hydraulic fluid flowing into cylinder 34*c* through port 30*c* exerts a pressure agains the adjacent surface of piston 26*c*.

The opposing surface of piston 26*c* is operatively coupled to an end portion of a piston rod 48*c* which extends axially through an end cap 52*c* suitably disposed in the other end of cylinder 22*c*. The opposing end portion of piston rod 48*c* extends into a hollow rocker arm 60*c* and is fixedly attached therein to a bearing sleeve (not shown). Rotatably supported in the bearing sleeve is an axial pin 72*c* having opposing end portions carrying respective rollers 74*c* which are slidably edged in mutually aligned slots 78*c* (only one of the rollers 74*c* are slidably engaged slot 78*c* being shown in FIG. 10). The slots 78*c* are axially disposed in opposing walls of the rocker arm 60*c*, such that the slots 78*c* extend virtually the entire length of the rocker arm.

The bearing sleeve attached to piston rod 48*c* also is fixedly attached to an end portion of a transversely disposed rod 112*c*. The rod 112*c* extends axially through an end wall of rocker arm 60*c* and into the torque control actuator 102*c* carried thereon, as previously described. The surface of rocker arm 60*c* which is fixedly attached to an end portion of centrally disposed shaft 82, as shown in FIG. 2, for example, has been omitted from FIG. 10 for purposes of clarity. However, it may be readily seen that the torque control actuator 102*c* operates to move the bearing sleeve 70*c* to one side or the other of the axial center line of output shaft 82. As a result, the force actuator 12*c* is provided with a moment arm to produce a torque which may aid or oppose the rotational bias produced by a load torque acting on the output shaft 82. In this manner, the force actuator 126 may produce a counter torque which is slightly greater than the rotational bias of shaft 82 to rotate the rocker arm 60*c* and the shaft 82 to a desired angular position. Then, the counter torque may be converted to a codirectional biasing torque to aid the load torque in returning the rocker arm 60*c* and the output shaft 82 to zero angular position.

From the foregoing, it will be apparent that all of the objectives of this invention have been achieved by the structures shown and described herein. It also will be apparent, however, that various changes may be made by those skilled in the art without departing from the spirit of the invention as expressed in the appended claims. It is to be understood, therefore, that all matter shown and described is to be interpreted as illustrative and not in a limiting sense.

I claim:

1. An adaptive actuator system adaptive to a variable load, and comprising:

a rotatable shaft disposed for coupling to the load and having a rotational bias applied thereto;

variable torque biasing means coupled to the shaft for cooperating with the load and providing a torque for rotating the shaft in a complying angular direction;

variable counter torque biasing means including an adjustable moment arm coupled to the shaft for opposing rotation of the shaft in said complying angular direction and providing a proportional counter torque for rotating the shaft in the opposing angular direction; and torque control means coupled to the torque biasing means and the counter torque biasing means for varying one with respect to the other and producing a preferred rotation of the shaft, and including means for sensing the rotation of the shaft to determine the magnitude of counter torque required.

2. An actuator system as set forth in claim 1 wherein the counter torque biasing means includes an arm extending radially from the shaft and means for applying a force to a portion of the arm at a variable distance from the shaft.

3. An actuator system as set forth in claim 2 wherein force applying means includes closed loop fluid means for hydraulically connecting a pressurized source of fluid to a force actuator having a movable member coupled to the arm.

4. An actuator system as set forth in claim 3 wherein the force actuator comprises a hollow cylinder having a piston slidably disposed therein and pivotally connected to said portion of the arm.

5. An actuator system as set forth in claim 4 wherein the closed loop fluid means includes an electrically operated control valve hydraulically connected between the pressurized source and the cylinder of the force actuator.

6. An actuator system as set forth in claim 5 wherein the control valve is disposed in electrical communication with said shaft rotation sensing means for operation in accordance therewith to hydraulically lock the piston of the force actuator in a desired position.

7. An actuator system adaptive to a variable load, and comprising:

a rotatable shaft disposed for coupling to the load and having a rotational bias applied thereto;

torque biasing means coupled to the shaft for cooperating with the load in biasing rotation of the shaft in a particular direction;

a moment arm extending radially from the shaft and having a longitudinally movable portion;

force actuator means coupled to the movable portion of the moment arm for applying a force thereto and developing a counter torque in opposition to the rotational bias of the shaft;

torque varying means carried on the moment arm and coupled to the longitudinally movable portion thereof for varying the length of the moment arm and correspondingly varying the magnitude of counter torque developed; and control means connected to the torque varying means for establishing a counter torque proportional to the rotational bias of the shaft and producing a desired rotation of the shaft, the control means including electrical means coupled to the shaft for sensing rotation thereof and producing corresponding output signals.

8. An adaptive actuator system as set forth in claim 7 wherein the torque varying means includes a torque actuator comprising a hollow cylinder having a reciprocally movable piston slidably disposed therein and dividing the cylinder into two chambers, one on either side of the piston, the piston also being coupled to the longitudinally movable portion of the moment arm.

9. An adaptive actuator system as set forth in claim 8 wherein the control means includes a servo valve hydraulically connected to a pressurized source of fluid and to an exhaust means, the servo valve being coupled to the two chambers of the torque actuator cylinder.

10. An actuator system as set forth in claim 9 wherein the servo valve is electrically operated to establish the proportional counter torque by connecting one of the cylinder chambers to the pressurized source of fluid and the other cylinder chamber to the exhaust means.

11. An actuator system as set forth in claim 10 wherein the servo valve is disposed in electrical communication with the shaft rotation sensing means for operation in accordance with the output signals thereof to determine the magnitude of counter torque required for achieving the desired rotation of the shaft.

* * * * *